US006758461B1

(12) United States Patent
Omarsson

(10) Patent No.: US 6,758,461 B1
(45) Date of Patent: Jul. 6, 2004

(54) FUEL-AIR MIXTURE APPARATUS

(76) Inventor: Kristian Bjorn Omarsson, Grund Villingsholltshreppi, 801 Selfoss (IS)

( * ) Notice: Subject to any disclaimer, the term of this patent is extended or adjusted under 35 U.S.C. 154(b) by 0 days.

(21) Appl. No.: 09/720,833

(22) PCT Filed: Jun. 28, 1999

(86) PCT No.: PCT/IB99/01214

§ 371 (c)(1),
(2), (4) Date: May 14, 2002

(87) PCT Pub. No.: WO00/01940

PCT Pub. Date: Jan. 13, 2000

(30) Foreign Application Priority Data

Jul. 1, 1998 (GB) ..... 9814100

(51) Int. Cl.[7] ..... F02M 29/04

(52) U.S. Cl. ..... 261/50.1; 48/189.4; 48/189.6; 123/590; 123/593; 261/50.2; 261/78.1; 261/81; 261/DIG. 55

(58) Field of Search ..... 261/78.1, 81, 50.1, 261/DIG. 55; 123/590, 593; 48/189.4, 189.6

(56) References Cited

U.S. PATENT DOCUMENTS

| | | | | | |
|---|---|---|---|---|---|
| 1,310,692 | A | * | 7/1919 | Denner | 48/189.4 |
| 1,481,413 | A | * | 1/1924 | Cameron | 48/189.4 |
| 1,503,371 | A | * | 7/1924 | Meyer | 48/189.4 |
| 1,515,408 | A | * | 11/1924 | Puffer | 48/189.4 |
| 1,790,854 | A | * | 2/1931 | Defrance et al. | 48/189.4 |
| 2,399,841 | A | * | 5/1946 | Ware | 261/DIG. 55 |
| 2,925,257 | A | * | 2/1960 | Cohn | 261/78.1 |
| 3,458,297 | A | * | 7/1969 | Anderson | 48/189.4 |
| 3,544,290 | A | * | 12/1970 | Larson, Sr., et al. | 261/78.1 |
| 3,640,512 | A | * | 2/1972 | Morgenroth | 261/50.1 |
| 3,814,391 | A | * | 6/1974 | Cedarholm | 261/50.1 |
| 3,826,235 | A | * | 7/1974 | Pasbrig | 123/590 |
| 3,857,912 | A | * | 12/1974 | Cedarholm | 261/78.1 |
| 3,966,430 | A | * | 6/1976 | Stephens | 123/590 |
| 3,998,195 | A | * | 12/1976 | Scott | 48/189.4 |
| 4,044,077 | A | * | 8/1977 | Gupta | 261/78.1 |
| 4,106,459 | A | * | 8/1978 | Asai et al. | 261/81 |
| 4,176,634 | A | * | 12/1979 | Martin | 261/81 |
| 4,628,890 | A | * | 12/1986 | Freeman | 123/593 |
| 4,672,940 | A | * | 6/1987 | Nakayama et al. | 123/590 |
| 6,283,460 | B1 | * | 9/2001 | Omarsson | 261/50.1 |

FOREIGN PATENT DOCUMENTS

| | | | |
|---|---|---|---|
| DE | 374738 | * 10/1923 | |
| GB | 452377 | * 8/1936 | |
| JP | 61-149564 | * 7/1986 | 261/78.1 |
| JP | 07-269866 | * 10/1995 | |
| WO | 82/01746 | * 5/1982 | 261/78.1 |
| WO | 93/01406 | * 1/1993 | |
| WO | 97/48897 | * 12/1997 | |

* cited by examiner

*Primary Examiner*—Richard L. Chiesa
(74) *Attorney, Agent, or Firm*—Sofer & Haroun, LLP

(57) ABSTRACT

In a fuel-air mixture device, downstream of a throttle (4) and a fuel introduction device, a block (51) is provided across the primary air passage (2). The block has a plurality of passageways (54) through it for air flow towards an inlet manifold. These improve mixture of the fuel and air.

27 Claims, 4 Drawing Sheets

FIG. 1
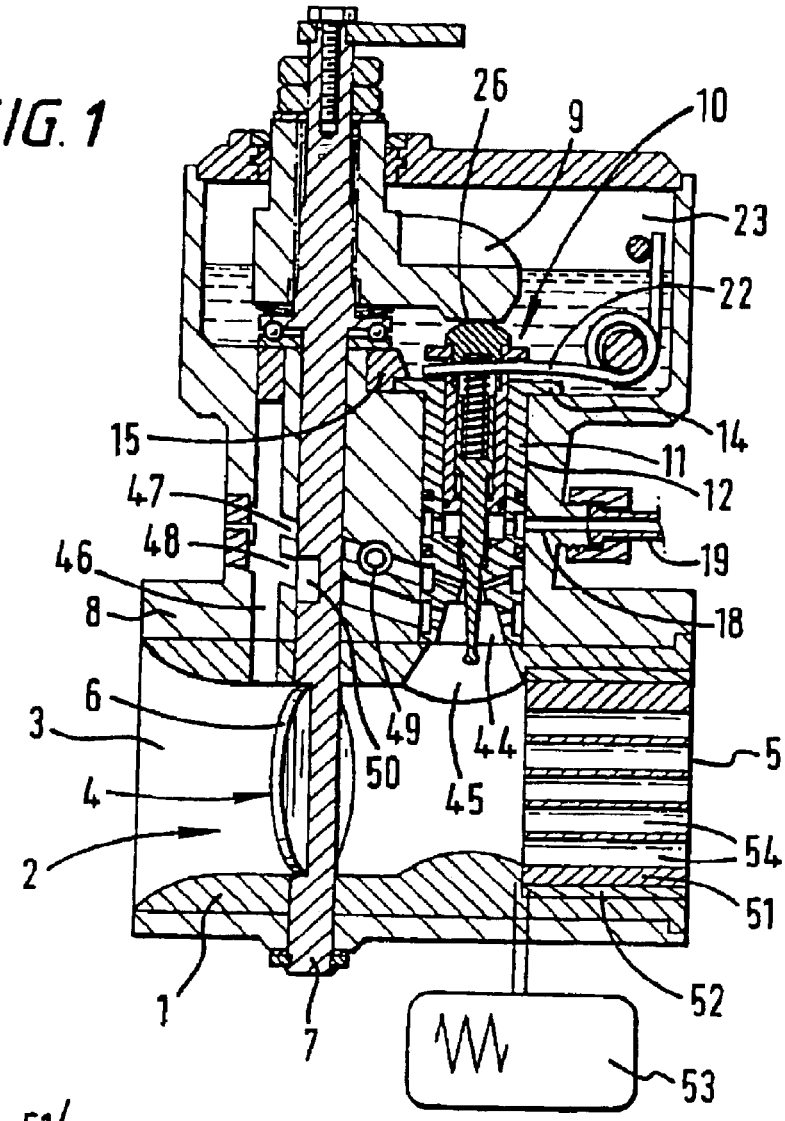
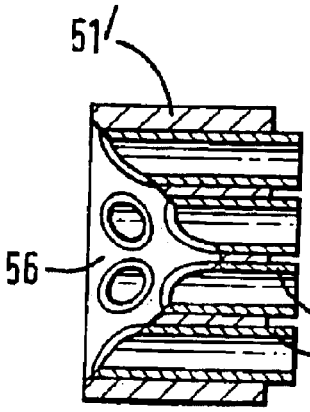
FIG. 4

FUEL-AIR MIXTURE APPARATUS

BACKGROUND OF THE INVENTION

The present invention relates to a fuel-air mixture apparatus, particularly for an internal combustion engine.

Fuel-air mixture apparatuses of the type where fuel is mixed with air prior to induction into the cylinder(s) of an engine generally rely on a pressure reduction at a throttle in the device to draw fuel into the device, in which case the device is known as a carburettor, or rely on fuel injection into the air as it passes through the device.

Generally, the prior devices rely on a single stage of mixture of fuel and air and are limited as regards the droplet size and total vaporisation of the fuel in the air which they induce. Inadequate vaporisation and too large a droplet size result in unburned and/or incompletely burnt fuel being present in the exhaust from the engine.

In my International Application No WO 97/48897, I have described and claimed an invention which I refer to below as "My Earlier Invention" and which comprises a fuel-air mixture apparatus having:

- a primary air passage having an inlet, an adjustable throttle and an outlet,
- a secondary air passage having an inlet and an outlet to the primary air passage between its adjustable throttle and its outlet,
- a variable orifice nozzle for introducing fuel into the secondary air passage, the nozzle having a mouth and a down-stream pointing tapered needle in the mouth to provide variability of the orifice by axial movement of the needle and
- a linkage or control device for linking or controlling the position of the needle to the position of the adjustable throttle in the primary air passage for adjustment of the orifice of the nozzle, the arrangement being such that in use the fuel mixes with the air flowing through the secondary air passage prior to mixing with the air flowing in the primary air passage and the fuel flow from the nozzle is matched to the position of the adjustable throttle.

THE INVENTION

The object of the present invention is to a further improved fuel air mixture apparatus.

The invention is based on passing a fuel-air mixture through an apertured vaporisation block in the apparatus to enhance the degree of mixing of the fuel with the air.

According to my present invention, there is provided a fuel-air mixture device comprising:

- a primary air passage having an inlet, an adjustable throttle and an outlet,
- a variable orifice nozzle for introducing fuel to the primary air passage, the nozzle having a mouth and a tapered needle in the mouth to provide variability of the orifice by axial movement of the needle, the needle being arranged transversely of the primary air passage and
- a linkage or control device for linking or controlling the position of the needle to the position of the adjustable throttle in the primary air passage for adjustment of the orifice of the nozzle and
- an apertured vaporisation block having a plurality of air passageways through the block, which subdivide a portion of the primary air passage between the fuel introduction position and the outlet.

The apertured vaporisation block may be integral with a member defining the primary air passage. Alternatively it may be fitted to the latter. In this case, the apertured vaporisation block may be mounted in such manner as to be ultrasonically excitable. Typically this can be by mounting the block in an ultrasonically excitable ring. Alternatively, the passageways in the block can be lined by ultrasonically excitable tubes.

The apertured vaporisation block can be a solid block in which the air passageways are formed by machining or casting. Alternatively, the apertured vaporisation block can be laid up from a plurality of layers, preferably by winding, the layers having regular formations extending out from each layer to space it from the next layer. The formations at each layer can be continuous with the formations at the next or inter-spaced with the formations at the next.

In one preferred embodiment, the apertured vaporisation block is provided wholly downstream of the position of the fuel introduction means, preferably with an upstream face of the apertured vaporisation block being formed concavely, preferably conically.

In another preferred embodiment, the apertured vaporisation block is provided at and extending downstream of the position of the fuel introduction means.

Whilst I envisage the contrary, I prefer that the present fuel-air mixture apparatus should be fully in accordance with My Earlier Invention, that is to say incorporating:

- a secondary air passage having an inlet and an outlet to the primary air passage between its adjustable throttle and its outlet, the arrangement being such that in use the fuel mixes with the air flowing through the secondary air passage prior to mixing with the air flowing in the primary air passage and the fuel flow from the nozzle is matched to the position of the adjustable throttle.

In the embodiment wherein the apertured vaporisation block is provided at and extending downstream of the position of the fuel introduction means, the apertured vaporisation block has at least one transverse bore leading from the secondary air passage to a respective one of the air passageways through the block. Each of the passageways can have a transverse bore leading from the secondary air passage. Alternatively, some of the air passageways may not be in communication with the secondary air passage and not receiving fuel-air mixture in use. Some of the air passageways may be in communication with the secondary air passage only via others of them.

The fuel introduction needle may extend into one or more of the air passageways in the apertured vaporisation block.

It is envisaged that the passageway(s) having the transverse bore(s) can be configured as venturi(s) with the narrowest throat(s) being at the orifice(s) of the transverse bore.

To aid mixture of the fuel with the air in the passageways, the latter can have turbulence inducing formations downstream of the transverse bore.

To help understanding of the invention, a specific embodiment thereof will now be described by way of example and with reference to the accompanying drawing, in which:

FIG. 1 is a cross-sectional side view of a fuel-air mixture apparatus of the invention;

FIG. 4 is a similar view of an alternative air passageway block;

Figure 2:
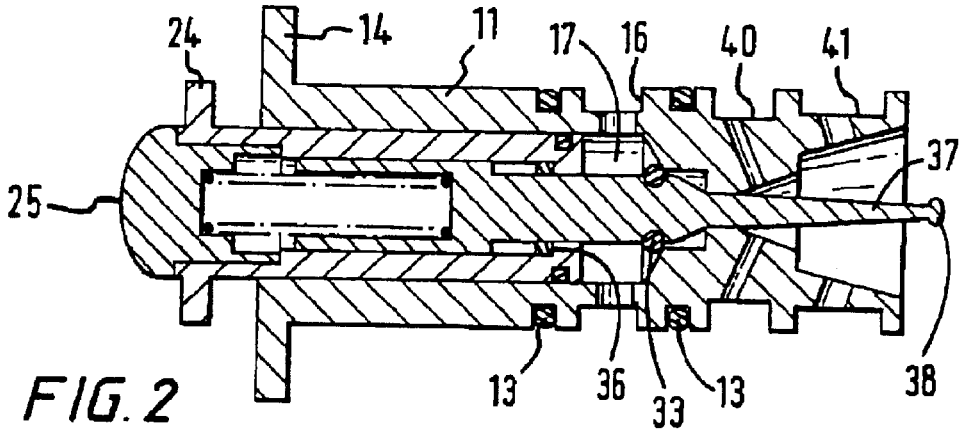
FIG. 2 is a scrap cross-sectional view on a larger scale of the needle actuator in the apparatus of FIG. 1 with the needle in its closed position.

The fuel-air mixture device shown in FIG. 1 is a carburettor. It has an air passage member 1 defining a primary air passage 2 with an inlet 3, an adjustable throttle 4 and an outlet 5. The inlet will be connected in use to an air cleaner (not shown), the outlet will be connected to an engine manifold (not shown) and the throttle will be connected to a throttle control (also not shown). The throttle has a vane 6 carried on a shaft 7 journalled in a body 8—into which the air passage member 1 is fitted—and having at one end a cam plate 9 against which a needle actuator 10 bears.

Figure 3:
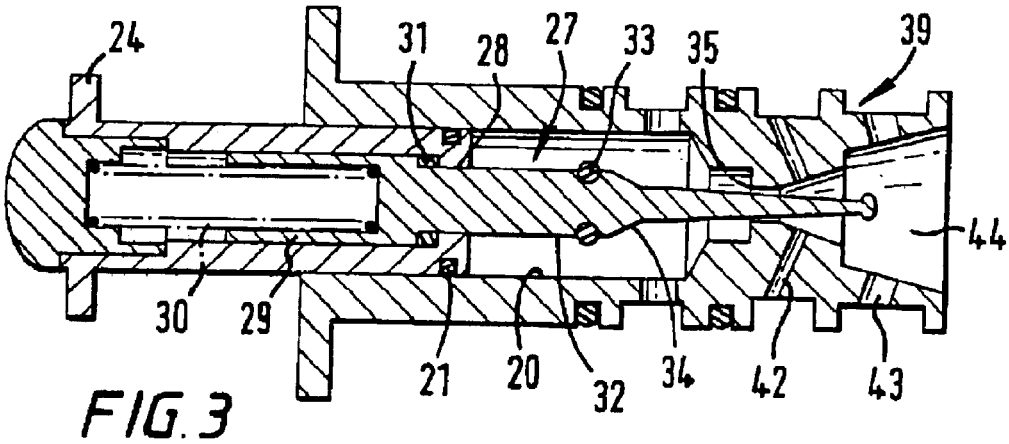
FIG. 3 is a similar view of the actuator with the needle in its open position.

Referring additionally to FIGS. 2 & 3, the needle actuator is slidingly accommodated in a needle carrier 11 fitted into a bore 12 in the body 8 and sealed there by a pair of O-rings 13. The needle carrier is retained by a flange 14 against which a block 15 acts, the block being held in place by the throttle shaft 7. Between the O-rings 13, the needle carrier has a circumferential groove 16, which opens to the interior 17 of the needle carrier 11. A fuel supply duct 18 in the body communicates with a fuel supply line 19 and the groove 16. The interior of the needle carrier is defined by a bore 20 in which the needle actuator 10 is accommodated in a fuel tight manner, with a seal 21 in a groove at the bottom end of the actuator. A spring 22 in a lubricant chamber 23 acts beneath a flange 24 on the needle actuator and urges the latter via an end dome 25 against a rotary cam surface 26 of the cam plate 9. A needle 27 is carried axially of the needle carrier in a bore 28 in the needle actuator 10. The needle has a head 29 accommodated in the actuator. A spring 30 captivated by the dome 25 urges the needle 27 towards the primary air passage 2. A seal 31 on the needle seals it to its actuator 10. A shank 32 of the needle extends from the actuator and has at it opposite end a groove carrying an O-ring 33 and a steep taper 34, which can seat in an internal orifice 35 in the needle carrier 11, with the O-ring 33 seating just outside the orifice (see FIG. 2), when the needle actuator is displaced so far by the cam as cause the head 29 and/or the seal 31 to lift from and abutment 36 in the carrier on which it normally engages, as shown in FIG. 2.

In the normal operating position of the cam plate 9, as shown in FIG. 3, with the needle actuator lifted by the spring 22, the needle head 29, seal 31 and abutment 36 are held together and the taper 34 is drawn clear of the orifice 35. The needle has a finely tapered needle proper 37 extending on through the orifice from the thin end of the steep taper, for varying the extent to which the orifice is open to the passage of fuel in accordance with the longitudinal position of the needle. This position is directly linked to the position of the throttle by the cam.

The needle terminates in a "pip" 38, which encourages any fuel running along its fine taper to shed as a fine droplets.

Beyond the orifice 315 of the needle carrier 11, it has an extension 39 having two external grooves 40,41, from which lead bores 42,43 to an outwardly tapering mouth 44 of the carrier. This is in register with a similarly tapering opening 45 in the air passage member 1, opening into the primary air passage 2.

A secondary air passage 46 leads from the primary air passage 2 upstream of the throttle 4. The passage 46 branches into two 47,48. The smaller 47 of these leads via a slow running, secondary air flow adjustment 49 to the upper groove 40, whose bores 42 open to the narrow end of the tapered mouth 44. The larger secondary air branch 48 intercepts the bore 49 in which the throttle shaft 7 is journalled. At the interception. the shaft has a flat 50, which aligns with the branch when the throttle is open, but closes the branch when the throttle is closed for slow running whereby the secondary air all passes via the other branch. The larger branches opens into the groove 41, via which its air passes on to the bores 43 and into the mouth 44 for mixing with the fuel metered by the needle.

Down-stream of the mouth 44, a block 51 is provided across the primary air passage 2. It is mounted in a ring 52 of piezoelectric material provided with an excitation circuit 53. The block has a plurality of passageways 54 through it for air flow towards the inlet manifold. These increase the turbulence in the air flow and increase the surface area on which fuel can deposit as fine droplets during the periods of stagnation corresponding to compression, ignition and exhaust for a single cylinder engine.

In operation of the carburettor, the throttle is opened. This allows the needle to move back from its position closing the orifice 34. Fuel, generally petrol, is allowed to flow at a rate appropriate to the throttle opening. It enters the mouth 44 and mixes with the secondary air flow. This air and the fuel, which represent a rich andnon-homogeneous mixture, flows on to the primary air passage. Here mixture of the fuel and air reaches the desired composition. On entering the passageways 54, the homogeneity is improved by turbulence in the passageways and by the provision of a large surface area on which fuel can deposit during stagnation and be reevaporated during air flow. Further turbulence occurs on exit from the passageways.

FIG. 4 shows an alternative construction of the block 51', in which the ring 52 is dispensed with and replaced by a series of piezoelectric tubes 55, which are all excitable. This block also has a conically, concave upstream face 56, which encourages laminar flow in the tubes 55. In a further, simpler alternative, the piezoelectric elements can be dispensed with as in the following embodiment.

Figure 5:
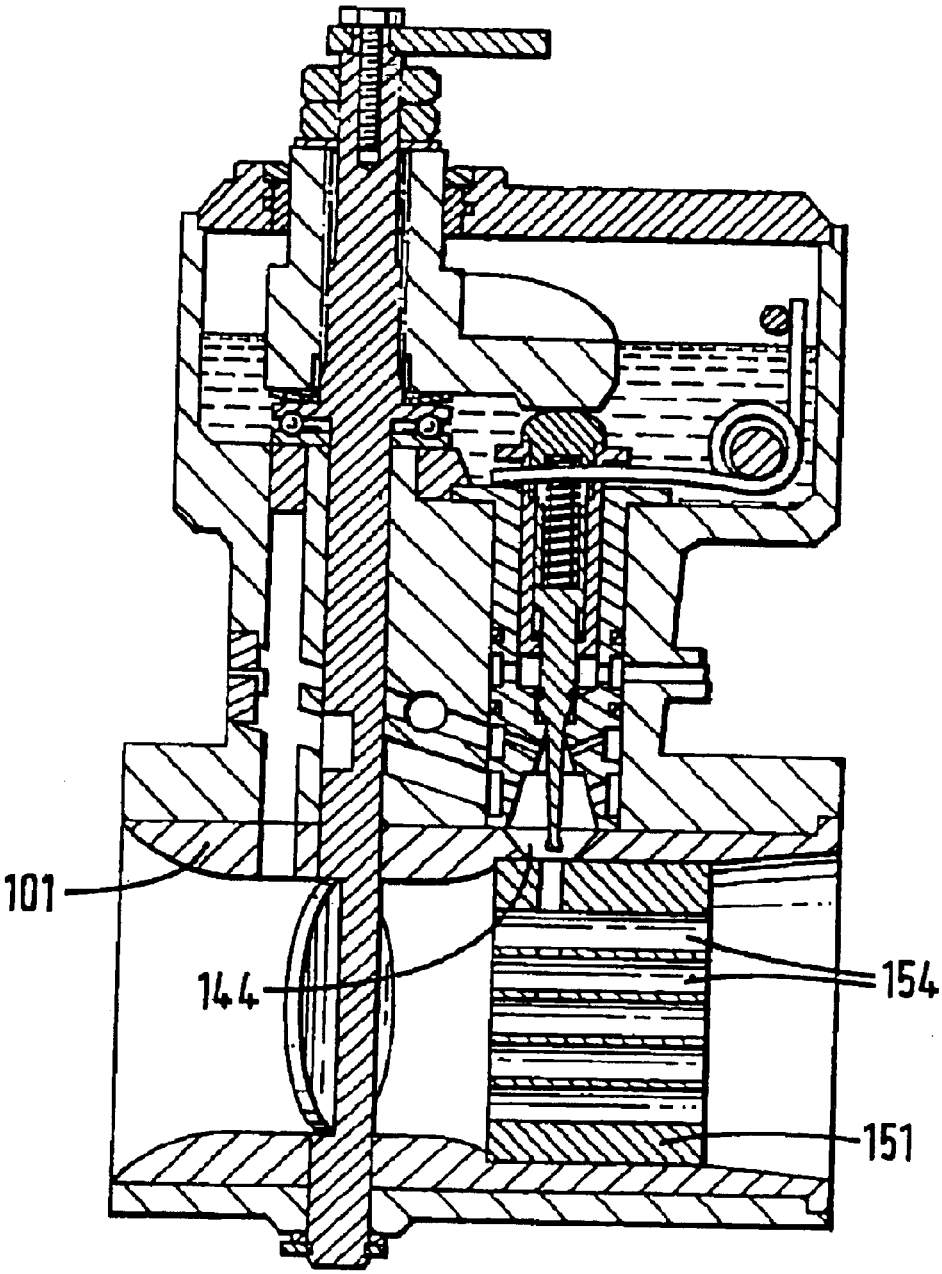
FIG. 5 is a view similar to FIG. 1 of an alternative apparatus of the invention.
Figure 6:
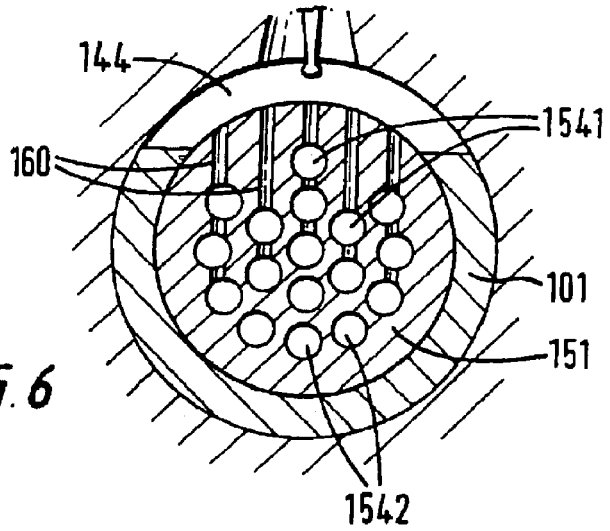
FIG. 6 is a cross-sectional end view of the air passageway block in the apparatus of FIG. 5.

Turning now to FIGS. 5 & 6, the carburettor there shown is essentially similar to that of FIGS. 1, 2 & 3, except that the block 151 is positioned to receive the secondary air flow directly into its passageways 154. In place of the mouth 44. the air passage member 101 has a V-slot 144 cut in it, to spread partially around the block. The block has a number of bores 160 opening from the slot 144 to convey the flow of secondary air and fuel to some of the passageways 1541. Others 1542 do not receive secondary airflow. The fuel is mixed with air flowing in these downstream of the block 151 due to turbulence in the air streams leaving the passageways.

A number of variants can be envisaged. The needle may extend into one of the radial bores aligned with the needle. As shown the passageways 154 are parallel bores. At least those 1541 into which the radial bores lead may be formed with venturis at the junction with these bores to encourage the secondary air flow into them. Further downstream of the bores, the passageways may be provided with surface roughness to promote turbulent air flow and mixture of the fuel and air flowing in them.

Figure 7:
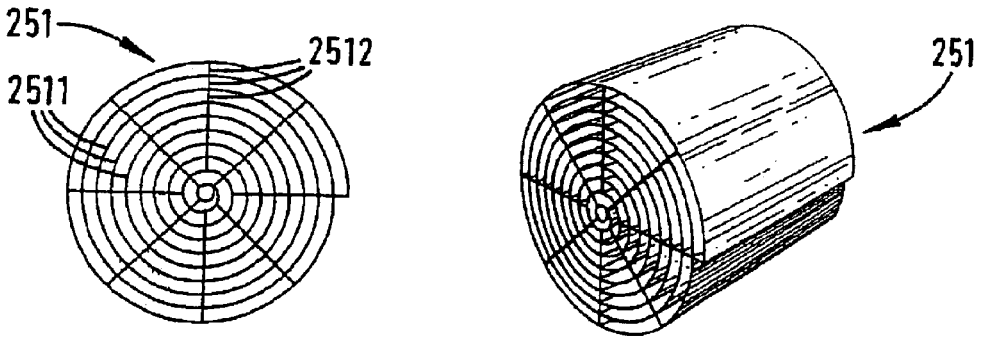
FIG. 7 is an end and perspective view of another alternative air passageway block.
Figure 8:
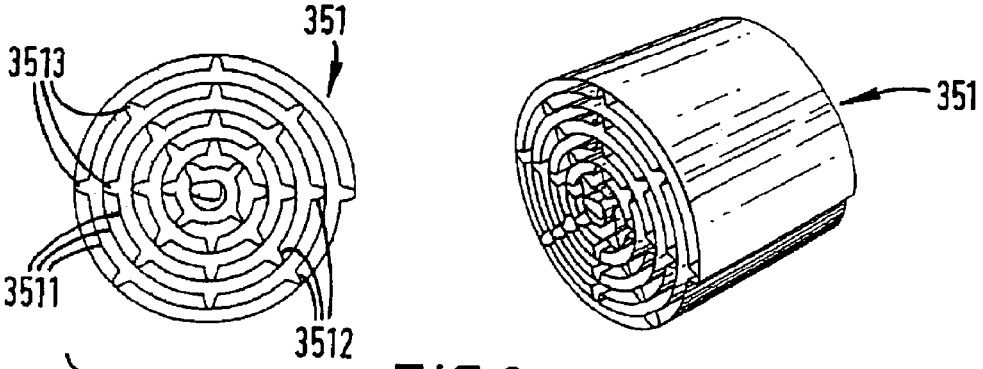
FIG. 8 is a similar pairs of views of yet another air passageway block.

Whilst the apertured vaporisation blocks 51, 51', 151 are solid blocks in which the passageways are formed by machining or casting, the alternatives 251,351 shown in FIGS. 6 & 7 formed of a plurality of layers 2511, 3511.

These are of sheet metal and spirally wound. The layers 2511 have a series of spacers 2512, which are two thicknesses of the sheet metal abutted and adhered together to form the spacers with a height equal to the spacing of the layers. The spacers are aligned to give structure rigidity. The layers 3511 have similar spacers 3512, but which are not abutted, and meet the next layer at peaks 3513, which are adhered to the next layer. The spacers can be angled with respect to the direction of their spiral winding, to give airflow through the block a vortex flow. As an alternative to the spacers being wound, they could be cast or moulded.

The invention is not intended to be restricted to the details of the above described embodiment. Various alternatives have been identified in the description above just before the description of the drawing. In addition, the passageways may be provided in a variety of sizes. As in my earlier invention, the direct mechanical linkage between the position of the needle and the position of the throttle can be replaced by electronic control.

What is claimed is:

1. A fuel-air mixture device comprising:

a primary air passage having an inlet, an adjustable throttle mounted on a rotary shaft arranged transversely of said primary air passage and an outlet;

a secondary air passage having an inlet from said primary air passage between its inlet and its adjustable throttle and an outlet to said primary air passage between its adjustable throttle and its outlet;

a variable orifice nozzle for introducing fuel to said primary air passage, said nozzle having a mouth for dispensing fuel into said secondary air passage upstream of its outlet;

a tapered needle arranged radially of said primary air passage and positioned in said mouth to provide variability of said orifice by axial movement of said needle, said needle being arranged transversely of said primary air passage with its small diameter end directed towards said primary air passage, the arrangement being such that in use, said fuel mixes with air flowing through said secondary air passage prior to mixing with air flowing in said primary air passage;

a linkage mechanism for controlling the position of said needle to the position of said adjustable throttle in said primary air passage for adjustment of said orifice of said nozzle;

an actuator for said tapered needle acted on by said linkage, with said needle extending between said actuator and said fuel dispensing mouth of said nozzle, the arrangement being such that as said throttle is opened, said needle is moved away from said primary air passage and out of said mouth of said nozzle to match fuel flow from said nozzle to said position of said adjustable throttle; and an apertured vaporisation block having a plurality of air passageways through said block, which subdivide a longitudinal portion of said primary air passage between said fuel introduction position and said outlet, the arrangement being such that fuel, air flowing through the secondary air passage and air flowing through said primary air passage all pass through said air passages for mixture of the fuel and the air; and wherein said linkage maintains a cam plate carried on said transverse, throttle-carrying shaft and having a cam surface directed towards said primary air passage, with said actuator for said tapered needle bearing against said cam plate.

2. A fuel-air mixture device according to claim 1, including a spring for lifting said needle from said mouth of said nozzle, under control of said cam plate, as said throttle is opened.

3. A fuel-air mixture device according to claim 1, wherein said apertured vaporisation block is integral with a member defining said primary air passage.

4. A fuel-air mixture device according to claim 1, wherein said apertured vaporisation block is a member fitted to said primary air passage.

5. A fuel-air mixture device according to claim 4, wherein said apertured vaporization block is mounted in such manner as to be ultrasonically excitable.

6. A fuel-air mixture device according to claim 5, wherein said apertured vaporisation block is mounted in an ultrasonically excitable ring.

7. A fuel-air mixture device according to claim 5, wherein said passageways in said block are lined by ultrasonically excitable tubes.

8. A fuel-air mixture device according to claim 1, wherein said apertured vaporisation block is a solid block in which said air passageways are formed by machining or casting.

9. A fuel-air mixture device according to claim 1, wherein said apertured vaporisation block is laid up from a plurality of layers, preferably by winding, said layers having regular formations extending out from each layer to space it from said next layer.

10. A fuel-air mixture device according to claim 9, wherein said formations at each layer are continuous with said formations at the next.

11. A fuel-air mixture device according to claim 9, wherein said formations at each layer are inter-spaced with said formations at the next.

12. A fuel-air mixture device according to claim 1, wherein said apertured vaporisation block is provided wholly downstream of the position of said fuel introduction means.

13. A fuel-air mixture device according to claim 12, wherein an upstream face of said apertured vaporisation block is concavely formed, preferably conically.

14. A fuel-air mixture device according to claim 1, wherein said apertured vaporisation block is provided at and extending downstream of the position of said variable orifice nozzle.

15. A fuel-air mixture device according to claim 1, wherein said apertured vaporisation block has at least one transverse bore leading from said secondary air passage to a respective one of said air passageways through said block.

16. A fuel-air mixture device according to claim 15, wherein each of said passageways has a transverse bore leading from said secondary air passage.

17. A fuel-air mixture device according to claim 15, wherein some of said air passageways are not in communication with said secondary air passage, whereby they do not receive fuel-air mixture in use.

18. A fuel-air mixture device according to claim 15, wherein some of said air passageways are in communication with said secondary air passage only via others of them.

19. A fuel-air mixture device according to claim 14, wherein said fuel introduction needle extends into one or more of said air passageways in said apertured vaporisation block.

20. A fuel-air mixture device according to claim 15, wherein said passageway or each said passageway having said transverse bore or each said bore is configured as a venturi with said narrowest throat being at said orifice(s) of said transverse bore.

21. A fuel-air mixture device according to claim 15, wherein said passageway(s) have turbulence inducing formations downstream of said transverse bore(s), to aid mixture of the fuel with the air in said passageways.

22. A fuel-air mixture device according to claim 1, wherein said needle actuator is accommodated in a fuel tight manner in a needle carrier and extends into a lubricant chamber where said cam plate acts on it.

23. A fuel-air mixture device according to claim 22, wherein said needle is carried axially of said needle actuator and spring biased towards said primary air passage for closure of a fuel outlet orifice from said needle carrier to said primary air passage by engagement of a taper of said needle in said orifice.

24. A fuel-air mixture device according to claim 23, wherein said needle carries an O-ring arranged to seal additionally said orifice with said needle.

25. A fuel-air mixture device according to claim 22, wherein said needle carrier has an extension in communication with said primary air passage and said extension has two outlets from said secondary air passage into said extension.

26. A fuel-air mixture device according to claim 25, wherein one of said outlets is from a slow running branch of said secondary air passage, having a slow running air flow adjustment and a second branch which is normally open, except when closed by a closure valve on closure of said throttle.

27. A fuel-air mixture device according to claim 26, wherein said closure valve comprises a flat on a shaft of said throttle, which is arranged to open said branch when said throttle is open.

* * * * *